US005566658A

United States Patent [19]

Edwards et al.

[11] Patent Number: 5,566,658

[45] Date of Patent: Oct. 22, 1996

[54] CLAMPING LOAD DISTRIBUTOR AND TOP STOP FOR A FUEL INJECTOR

[75] Inventors: Steven D. Edwards, Columbus; Daniel K. Hickey, Greenwood; Dave A. Olson, Columbus; George L. Muntean, Columbus; Chandresh Shah, Columbus; David L. Eastman, Columbus, all of Ind.

[73] Assignee: Cummins Engine Company, Inc., Columbus, Ind.

[21] Appl. No.: 427,114

[22] Filed: Apr. 21, 1995

[51] Int. Cl.[6] ..... F02M 55/02

[52] U.S. Cl. ..... 123/470

[58] Field of Search ..... 123/468, 469, 123/470, 509

[56] References Cited

U.S. PATENT DOCUMENTS

| | | | |
|---|---|---|---|
| 3,038,456 | 6/1962 | Dreisin | 123/470 |
| 3,334,617 | 8/1967 | Palkowsky | 123/470 |
| 4,133,321 | 1/1979 | Hofmann et al. . | |
| 4,203,402 | 5/1980 | Freyn | 123/470 |
| 4,206,725 | 6/1980 | Jenkel et al. | 123/470 |
| 4,403,586 | 9/1983 | Taniguchi . | |
| 4,519,371 | 5/1985 | Nagase et al. . | |
| 4,528,959 | 7/1985 | Hauser, Jr. . | |
| 4,648,556 | 3/1987 | Leblanc et al. . | |
| 4,829,646 | 5/1989 | Cigolotti et al. | 123/509 |
| 4,938,193 | 7/1990 | Raufeisen et al. . | |
| 5,121,731 | 7/1992 | Jones . | |
| 5,329,906 | 7/1994 | Jensen et al. | 123/470 |
| 5,419,298 | 5/1995 | Nolte et al. | 123/509 |

FOREIGN PATENT DOCUMENTS

| | | |
|---|---|---|
| 155024 | 3/1988 | U.S.S.R. . |
| 2177157 | 6/1985 | United Kingdom . |
| 2177450 | 6/1986 | United Kingdom . |

*Primary Examiner*—Thomas N. Moulis

*Attorney, Agent, or Firm*—Woodard, Emhardt, Naughton Moriarty & McNett

[57] ABSTRACT

A clamping load distributor and top stop disposed and connecting between a fuel injector body and a clamping device. The clamping load distributor functions as an intermediary to transmit the static clamping load from the clamping device to the fuel injector body. The clamping load distributor includes a cylindrically shaped main body having a bore extending therethrough that is disposed adjacent a coupling return spring. A cap is connected to the cylindrically shaped main body and functions as a top stop for limiting the outward axial movement of a mechanical linkage. The restriction on axial movement creates a small gap between the moving mechanical parts to allow a coating of lubrication to be obtained. The main body having a pair of clamp receiving portions formed therein for receiving a clamping load. An annular ring is formed on the bottom side of clamping load distributor radially inward from the clamp receiving portions for contacting the upper deck of the fuel injector body. The geometric relationship of the clamping load distributor functions to transfer the static clamping load radially inward towards the fuel injector units center of mass. The transferring of the clamping load radially inward results in a significant decrease in the occurrence of timing plunger seizure within the fuel injector unit.

17 Claims, 5 Drawing Sheets

CLAMPING LOAD DISTRIBUTOR AND TOP STOP FOR A FUEL INJECTOR

BACKGROUND OF THE INVENTION

The present invention relates in general to the design and construction of a load distribution apparatus for transmitting a static clamping load from a clamping device to an object. More particularly, the present invention relates to a clamping load distributor and top stop which is utilized as an intermediary for holding a fuel injector body to a cylinder head of an internal combustion engine.

Many internal combustion engines, whether compression ignition or spark ignition engines, are provided with fuel injection systems to satisfy the need for precise and reliable fuel delivery into the combustion chamber of the engine. Such precision and reliability is necessary to address the goals of increasing fuel efficiency, maximizing power output, and controlling the undesirable by-products of combustion.

A unit injector is a precision device that must meter the quantity of fuel required for each cycle of the engine and must develop the high pressure necessary to inject the fuel into the combustion chamber at the correct instant of the operating cycle. Many fuel injection units utilize a mechanical linkage from the engine, such as a push rod and rocker arm, to pressurize the fuel charge and obtain the desired fuel spray pattern. It is desirable to maintain a lubrication coating between the engaging surfaces in the mechanical linkage to reduce wear, spalling and metal fatigue. A top stop facilitates lash between the parts to enable proper lubrication therebetween. The mechanical linkage interacts with a timing plunger that is disposed within a bore formed in the fuel injector for engaging an incompressible liquid fuel. This mechanical pressurization of the liquid fuel produces an extremely high fuel injection pressure, often exceeding 20,000 p.s.i. (13,800 Newtons per square centimeter).

In the past, designers of internal combustion engines have generally used a mechanical clamping device to hold a fuel injection unit on the cylinder head. One approach is to affix a clamping device having a wishbone shaped fork at one end to the cylinder head. The clamping device is bolted to the cylinder head and the forks on the wishbone shaped end contact the top surface of the fuel injector body in two places, thereby holding the fuel injector unit in place. A second approach is to utilize a clamping plate that engages a flange formed on the outer perimeter of the fuel injector body. The clamping plate is secured to the engine by one, or a pair of bolts, thereby drawing the flange against the engine block and holding the fuel injector unit in place.

These two approaches of fastening a fuel injector unit to an internal combustion engine have a common limitation. The common limitation being that the mechanical clamping device imparts a concentrated clamping force to a portion of the fuel injector body. The concentrated clamping force distorts the bore formed in the fuel injector body thereby causing timing plunger scuffing, and ultimately the seizure of the timing plunger within the bore. Premature failure of the fuel injector unit is often attributed to the fuel injector body receiving a concentrated clamping load.

In order to try and solve, or at least minimize, the foregoing problem, designers have tried different approaches. For example, there have been a variety of load distribution devices conceived of over the years, for transferring static clamping loads produced by clamping devices.

The following listing of references is believed to be representative of such earlier designs.

| REFERENCES | | |
|---|---|---|
| U.S. Pat. No. | Patentee | Issue Date |
| 4,829,646 | Cigolotti et al. | May 16, 1989 |
| 4,571,161 | Leblanc et al. | Feb. 18, 1986 |
| 4,419,977 | Hillenbrand | Dec. 13, 1983 |
| 4,403,586 | Taniguchi | Sept. 13, 1983 |
| 3,387,867 | Rogers | June 11, 1968 |
| Patent No. | Applicant | Date |
| French No. 838,650 | Fives-Lille Company | March 10, 1939 |

Even with a variety of earlier designs, there remains a need for a clamping load distributor and top stop that is easy to install and which more uniformly distributes the transmission of the concentrated clamping force to the fuel injector body, thereby reducing the distortion of the bore formed in the fuel injector body. The present invention satisfies this need in a novel and unobvious way.

SUMMARY OF THE INVENTION

To address the unmet needs of prior fuel injection unit mounting devices, the present invention contemplates an apparatus for receiving a clamping load to secure a fuel injector unit to a cylinder head, the apparatus comprising: a body for receiving a portion of the fuel injector unit therein, the body having a first end and an opposite second end; a stop connected to the first end of the body, the stop for restricting the axial movement of the portion of the fuel injector unit receivable in the body; a clamp receiving portion for receiving the clamping load, the clamp receiving portion positioned within the body; and a contact portion contactable with the fuel injector unit and being connected to the second end of the body for transmitting the clamping load to the fuel injector unit, the contact portion being positioned radially inward from the clamp receiving portion.

One object of the present invention is to provide an improved load distributing top stop for fastening the fuel injector unit on the cylinder head of an internal combustion engine.

Related objects and advantages of the present invention will be apparent from the following description.

DESCRIPTION OF THE PREFERRED EMBODIMENT

Figure 1:
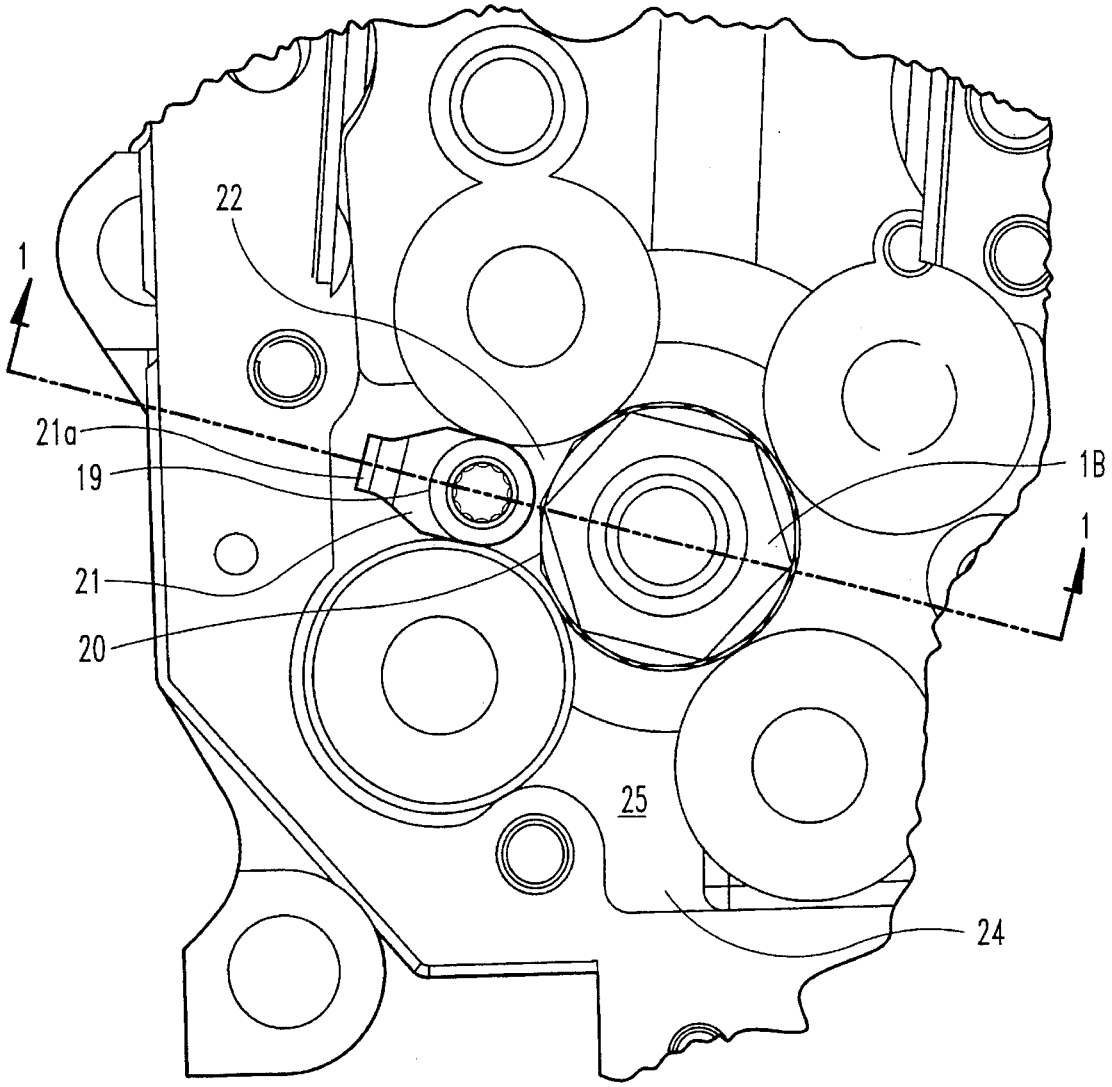
FIG. 1 is a top plan view of a clamping load distributor and top stop according to a typical embodiment of the present invention as assembled between a fuel injector unit and a cylinder head of an internal combustion engine.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a clamping load distributor 20 which is designed and manufactured in accordance with the present invention. Clamping load distributor 20 is designed to reduce the hold down clamp static load transmitted to the outer perimeter of the fuel injector body 22. A clamp 21 is provided for securing the fuel injector unit 18 to a cylinder head 24 of an internal combustion engine (not illustrated). In the preferred embodiment the hold down clamp 21 includes a first end 21*a* that contacts the cylinder head 24. A second opposite end of the hold down clamp 21 defines a pair of forks 21*b* and 21*c* that are formed in a spaced apart relationship with each other and are engagable with the clamping load distributor 20. A coplanar lower surface 21*d* of the pair of forks 21*b* and 21*c* is positioned to contact the clamping load distributor 20 when the hold down clamp 21 is mounted to the cylinder head 24. A fastener 19 passes through a clearance hole formed in the body of the hold down clamp 21.

In the preferred embodiment the fastener 19 defines a bolt. It is further contemplated that the fastener could alternatively define a threaded bolt and nut. The bolt 19 engages an internally threaded bore formed on the cylinder head 24. The torquing of bolt 19 transmits a hold down static load through the forks 21*b* and 21*c* to the clamping load distributor 20, thereby holding the fuel injector unit 18 against a deck 25 of cylinder head 24.

Figure 2:
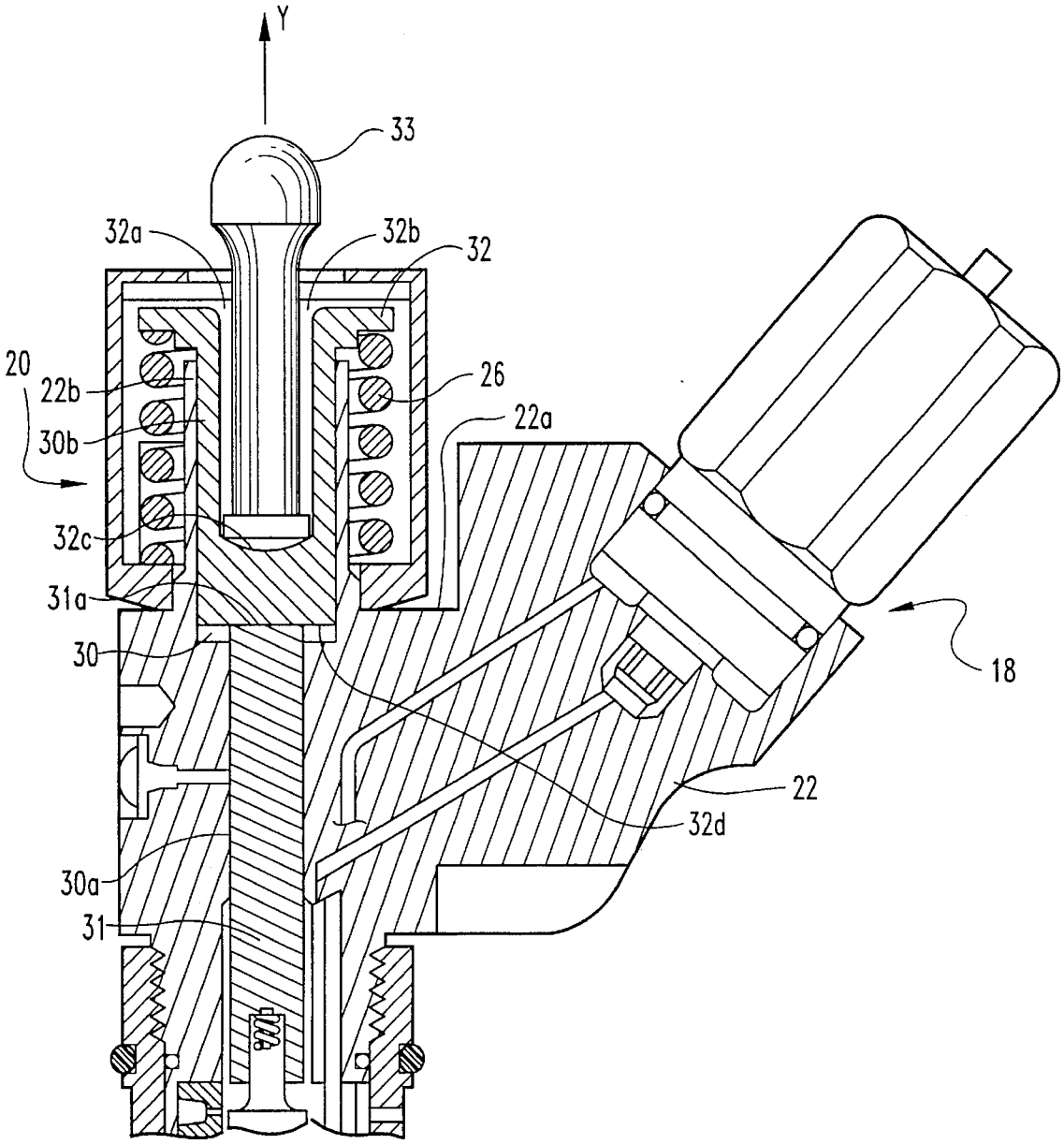
FIG. 2 is a side elevational view in full section of the FIG. 1 clamping load distributor and top stop as assembled on a fuel injector body with the clamp removed.
Figure 3:
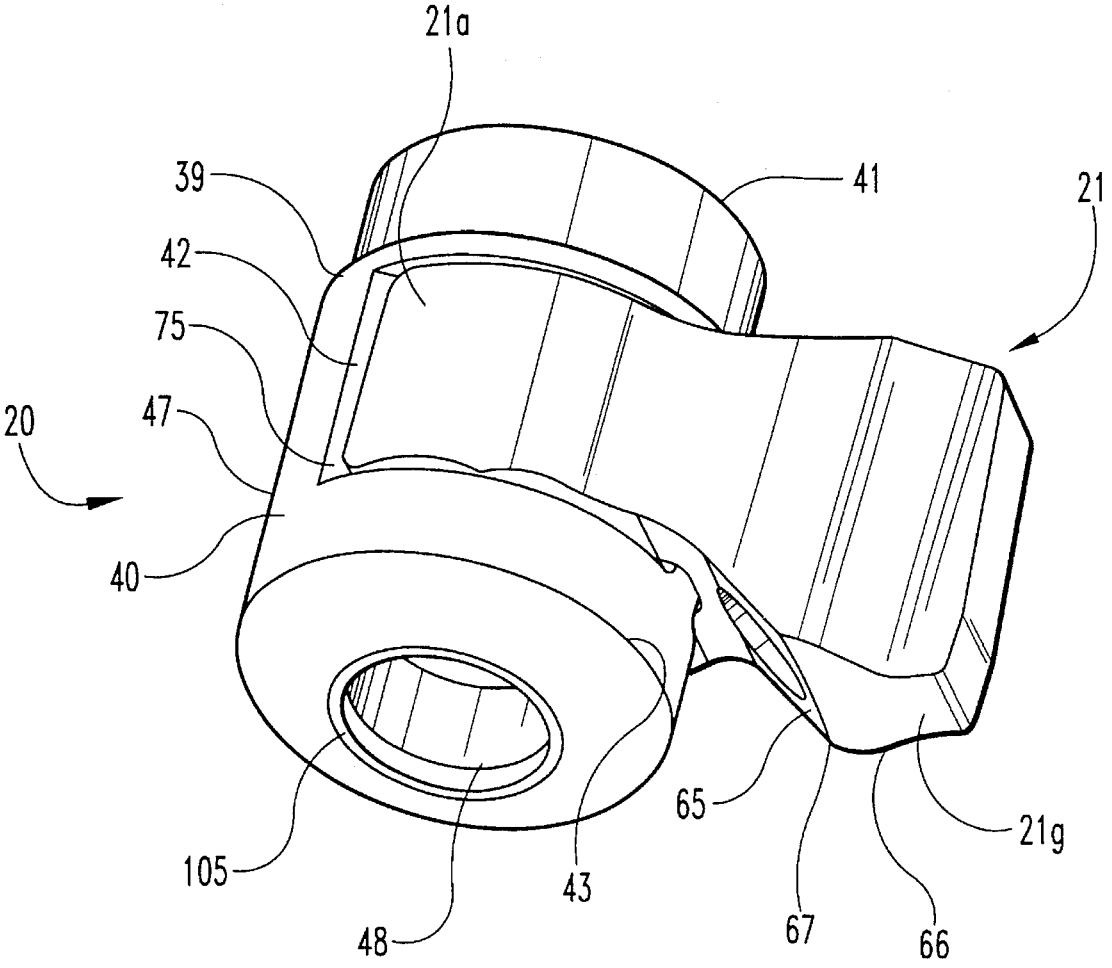
FIG. 3 is a perspective view of the FIG. 1 clamping load distributor and top stop with the clamp installed.

With reference to FIG. 2, there is illustrated the fuel injector unit 18 having the clamping load distributor 20 positioned around a portion of the outer circumference of a coupling return spring 26, and contacting the upper surface 22*a* of the fuel injector body 22. The fuel injector body 22 is formed preferably as a forged unit that includes an upstanding cylindrical portion 22*b*, and a central axial cavity 30 extending throughout the length of the fuel injector body 22. The axial cavity 30 is actually comprised of two coaxial and communicating cylindrical bores of differential diameters. First cylindrical bore 30*a* is defined in fuel injector body 22 and slideably receives a timing plunger 31. The second cylindrical bore 30*b* is defined in the upstanding cylindrical portion 22*b* of the fuel injector body 22 and slideably receives a coupling member 32. At the exposed portion 32*a* of the coupling member 32, a bore 32*b* and a load bearing surface 32*c* are formed. A link 33 is disposed within the bore 32*b* and contacts the load bearing surfacer 32*c* for transmitting a force to the coupling member 32, to overcome the spring force of coupling return spring 26. The link 33 functions in a well known fashion and is typically in contact with a valve train cam shaft (not shown) of the internal combustor engine. Link 33 reciprocates along a central axis Y in response to the angular position of the actuating valve train camshaft.

The coupling member 32 defines a lower surface 32*d* that is contactable with an upper surface 31*a* of timing plunger 31. In the preferred embodiment there is no mechanical fixation or attachment between the coupling member 32 and the timing plunger 31; only a compressive load is transmitted from the coupling member 32 to the timing plunger 31. However, in a another embodiment there is mechanical fixation between the coupling member 32 and the timing plunger 31. The compressive load transmitted from the coupling member 32 to the timing plunger 31 causes the axial movement of the timing plunger 31 which functions to pressurize the fuel charge disposed within the fuel injector unit 22.

Referring to FIGS. 3–7, there is illustrated the clamping load distributor 20 having a substantially cylindrical main body 40. In the preferred embodiment the main body 40 is of a unitary design and is formed from a steel blank. A predetermined amount of material is removed from the steel blank by a machining process which utilizes a turning operation and an EDM process to produce the desired geometric configuration described hereinafter. Alternatively, the main body 40 can be formed by any other suitable manner which provides a durable clamping load distributor with the desired dimensions, such as by a sintered powdered metal process, casting or forging. In the preferred embodiment the main body 40 has a hardness within the range of about Rockweel C 44–48.

The main body portion 40 of the clamping load distributor 20 includes: an upper body portion 39; a lower body portion 43; a pair of spaced apart clamp receiving portions 42; and an annular fuel injector body engagement portion 105. The upper portion 39 has an externally threaded surface (not illustrated) which is engagable with a cap 41. The cap 41 having a correspondingly threaded inner surface to facilitate interengagement of the respective parts. Cap 41 functions as a top stop which acts to restrict the axial movement of the coupling member 32. The top stop limits the outward axial movement of the coupling member 32 and the link 33. This limitation creates a small gap between the moving mechanical parts to allow a coating of lubrication to be obtained. Cap 41 having an aperture 103 therethrough which allows for the link 33 to contact the coupling member 32. In the preferred embodiment aperture 103 is of sufficient size to eliminate the contacting of cap 41 by the moving link 33.

Figure 4:
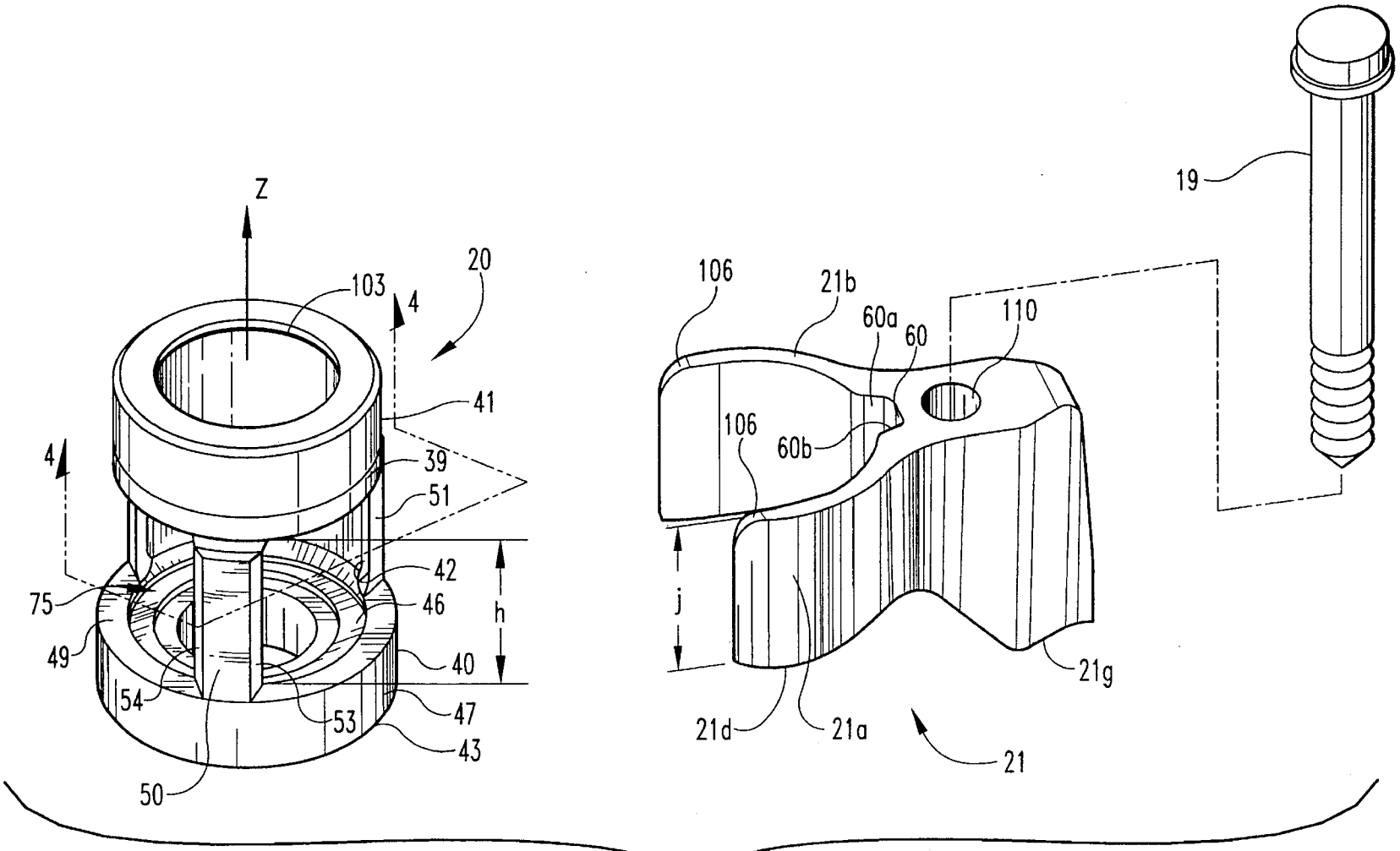
FIG. 4 is an exploded view of the FIG. 3 clamping load distributor and top stop.

With reference to FIG. 4, there is illustrated an exploded view of the clamping load distributor 20, bolt 19 and wishbone clamp 21. The main body 40 of clamping load distributor 20 includes a circumferential coupling return spring seat 46 which is disposed adjacent the cylindrical wall 47 of the main body 40. Coupling return spring seat 46 receives the coupling return spring 26 thereon. An internal diameter surface 48*a* is defined on bore 48 which passes through the fuel injector body engagement portion 105. Internal diameter surface 48*a* is larger than the outside diameter of the upstanding cylindrical portion 22*b* of fuel injector body 22. This relative difference in diameter size permits the clamping load distributor 20 to be placed during assembly around the upstanding cylindrical portion 22*b*.

The pair of clamp receiving portions 42 being positioned between the lower portion 43 and the upper portion 39 of the main body 40. Clamp receiving portions 42 define a pair of openings 75 within the main body 40 for receiving the forks 21*a* and 21*b* of clamp 21. Each of the clamp receiving portions 42 include a partial annular ring portion 49 that is formed substantially transverse to the longitudinal center line Z. The partial annular ring portions 49 form a clamp engagement portion that is contacted by the lower surface 21*d* of forks 21*a* and 21*b* respectively.

The opening 75 which comprise a part of the clamp receiving portions 42 have height 'h' that is greater than the height 'j' of the forks 21*a* and 21*b*. This relative difference in height allows for the ready insertion of the fork ends 21*a* and 21*b* within the clamping load distributor 20. Forks 21*a* and 21*b* have a rounded end 106 which facilitates the insertion of the forks into the openings 75.

Figure 6:
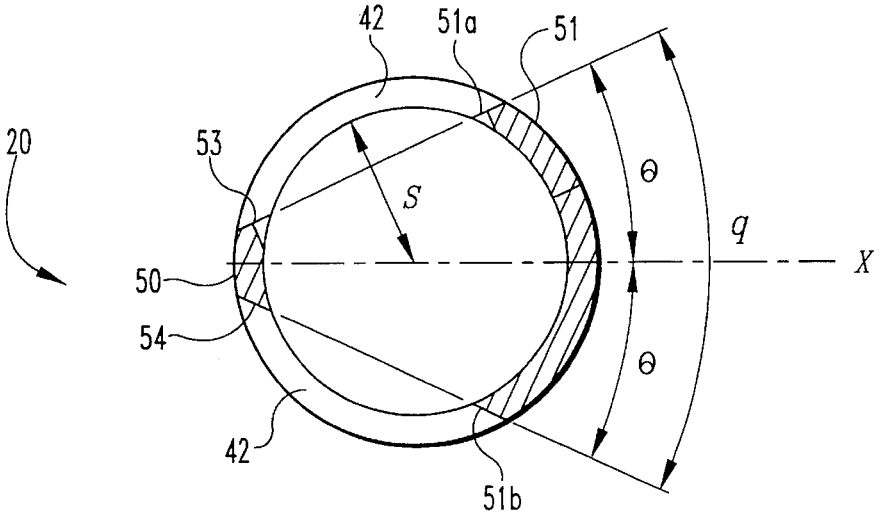
FIG. 6 is a plan view in full section taken along line B—B of the FIG. 4 clamping load distributor and top stop.

With reference to FIG. 6, there is illustrated a plan view in full section of the clamping load distributor 20 to facilitate an understanding of the relative location of the clamp receiving portions 42 and a strut member 50. In the preferred embodiment the strut member 50 and the partial annular member 51 comprise a supporting structure which connects the upper portion 39 with the lower portion 43. A central axis X is utilized as a reference to divide the clamping load distributor 20 in a horizontal plane. Strut member 50 includes a surface 53 which is formed at an angle Θ to the central axis X of clamping load distributor 20. In the preferred embodiment the angle Θ is about 25°. A corresponding surface 54 is formed on the opposite side of strut member 50 and is formed at the angle Θ from the central axis X The partial annular member 51 includes a first surface 51*a* that is formed at angle Θ and aligned with surface 53 of strut member 50. A second surface 51*b* on the partial annular member 51 is formed at angle Θ and aligned with the second surface 54 of strut member 50. An angle 'q' sweeps between the first surface 51*a* and the second surface 51*b*. In the preferred embodiment angle 'q' is about 50°.

In the preferred embodiment the clamp receiving portions 42 are located a distance of 's' from the center of the clamping load distributor 20. In the preferred embodiment the distance 's' is in the range of about 13 to 14 millimeters. This dimension controls where the clamping load engages the fuel injector body 22.

Wishbone shaped clamp 21 is preferably of a cast or forget manufacture with the forks 21*a* and 21*b* being alignable with the clamp receiving portions 42. A strut member engagement portion 60 is formed between the forks 21*a* and 21*b* of clamp 21. The strut member engagement portion 60 is designed and constructed to interengage with the surfaces 53 and 54 of strut member 50 to facilitate the proper placement of clamp 21 on the partial annular ring portions 49 of the clamping load distributor 20. More particularly, in the preferred embodiment the strut engagement portion 60 has surfaces 60*a* and 60*b* that are aligned with surfaces 53 and 54 of strut member 50. Upon the assembly of clamp 21 into the clamping load distributor 20 (FIG. 3) the forks 21*a* and 21*b* are disposed adjacent the clamp engagement portions 49 of clamping load distributor 20. Bolt 19 passes through a bore 110 in the clamp 21 to engage the cylindrical head 24. In the preferred embodiment the one bolt clamp 21 will apply an even load to the clamping load distributor 20, and will eliminate the necessity of a multi-step installation torquing procedure. The clamp 21 has a relief 65 formed on its bottom side 21*g* and a second relief 66 located proximate thereto. A contact line or portion 67 is located between the relief 65 and relief 66 for contacting the fuel injector body 22.

Figure 5:
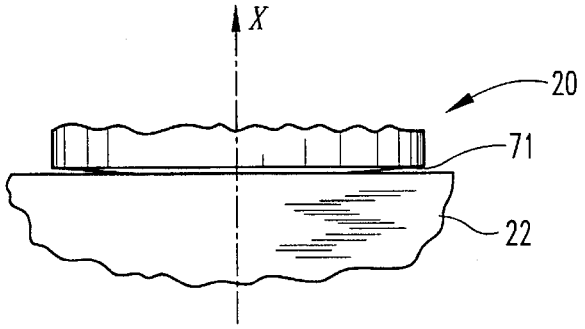
FIG. 5 is a partial side elevational view of the FIG. 3 clamping load distributor and top stop as positioned on a fuel injector body with the clamp removed.
Figure 7:
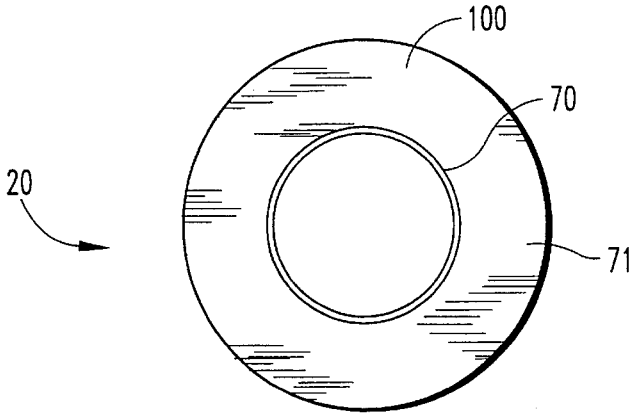
FIG. 7 is a bottom plan view of the FIG. 3 clamping load distributor and top stop for a fuel injector.

With reference to FIGS. 5 and 7, there is illustrated the fuel injector body engagement portion 105 of clamping load distributor 20. An annular ring 70 is formed on the bottom side 100 of the main body 40 for contacting the upper surface of the fuel injector body 22. The annular ring 70 is formed substantially parallel to the clamp engagement portions 49. A relief surface 71 formed on the bottom side 100 of main body 40 defines an annular surface that slopes away in all directions from the cylindrical wall member 47 of the clamping load distributor 20. In the preferred embodiment relief surface 71 is formed on the bottom side 100 of main body 40 at about a 5° angle of inclination. The geometric relationship between the relief surface 71 and the annular ring 70 necessitates that only the annular ring 70 contacts the fuel injector body 22. Annular ring 70 being spaced radially inward from the clamp receiving portions 42. It is understood that annular ring 70 provides the contact region to transmit the clamping load from clamp 21 through the clamping load distributor 20 to the fuel injector body 22.

After the clamping load distributor 20 has been located on the upper surface of the fuel injector body 22, the subsequent torquing of bolt 19 draws the forks 21*a* and 21*b* against the clamp engagement portions 49 defined on the clamping load distributor 20. The drawing of the forks 21*a* and 21*b* against the clamp engagement portions 49 transmits the clamping load to the fuel injector body 22 and securely holds the fuel injector unit to the cylinder head 24.

With reference to FIGS. 1–7, there is illustrated the clamping load distributor 20 that provides a significant improvement in transmitting the static clamping load from the forks of the clamp 21 to the annular ring 70 of the clamping load distributor 20. The clamping load distributor 20 transfers the static clamping load from the clamp engagement portions 49 to the annular ring 70 which contacts the upper surface of the fuel injector body 22. The geometric relationship between the clamp engagement portion 49 and the annular ring 70 transfers the clamping load radially inward towards the center of mass of the fuel injector body 22. A resulting benefit is the significant decrease in the distortion of the first cylindrical bore 30*a* which has the timing plunger 31 slideable disposed within. In decreasing the distortion of the first cylindrical bore 30*a* there is a corresponding reduction of the scuffing of timing plunger 31. The reduction of the timing plunger 31 scuffing minimizes the occurrence of timing plunger seizure and ultimately reduces fuel injector unit 18 failure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for receiving a clamping load to secure a fuel injector unit to a cylinder head, comprising:

a body for receiving a portion of the fuel injector unit therein, said body having a first end and an opposite second end;

a stop connected to said first end of said body, said stop for restricting the axial movement of said portion of the fuel injector unit receivable in said body;

a clamp receiving portion for receiving the clamping load, said clamp receiving portion positioned within said body; and a contact portion contactable with the fuel injector unit and being connected to said second end of said body for transmitting the clamping load to the fuel injector unit, said contact portion being positioned radially inward from said clamp receiving portion.

2. In combination:

a fuel injector unit;

a cylinder head;

a clamp connectable to said cylinder head; and an apparatus for receiving said clamp to secure said fuel injector unit to said cylinder head, comprising:

a body having an aperture for receiving a portion of said fuel injector unit therein, said body having a first end and an opposite second end;

a stop connected to said first end of said body for restricting the axial movement of said portion of said fuel injector unit;

a clamp receiving portion within said body for receiving said clamp; and a contact portion contactable with said fuel injector unit, said contact portion being connected to said second end of said body for transmitting a clamping load from said clamp to the fuel injector unit, said contact portion disposed radially inward from said clamping receiving portion.

3. An apparatus situated between a fuel injector body and a clamping device, said apparatus comprising:

a substantially cylindrical body having a first end and an opposite second end, said body having an aperture extending between said first end and said second end for receiving a portion of the fuel injector body;

a clamping device receiver aligned with said cylindrical body, said clamping device receiver located between said first end and said second end; and a contact portion connected to said second end of said body for transmitting a clamping load from the clamping device to the fuel injector body, said contact portion disposed radially inward relative to said clamping device receiver.

4. The apparatus of claim 1, wherein said clamp receiving portion defining an opening in said body.

5. The apparatus of claim 4, wherein said clamp receiving portion defining a pair of spaced partial annular rings, and the apparatus having associated therewith a hold down clamp with a pair of spaced forks that transmit the clamping load to said clamp receiving portion.

6. The apparatus of claim 5, wherein said body is substantially cylindrical and having a strut member separating said pair of spaced partial annular rings, and wherein said body having a partial annular member separating said pair of spaced partial annular rings.

7. The apparatus of claim 4, wherein said clamp receiving portion being positioned in the range of about 13–14 millimeters from the center of said body, and wherein said contact portion defining an annular ring formed substantially parallel to said clamp receiving portion.

8. The apparatus of claim 2, wherein said clamp receiving portion defining a pair of spaced partial annular rings, and wherein said clamp having a pair of spaced forks for transmitting the clamping load to said clamp receiving portion.

9. The apparatus of claim 8, wherein said body is substantially cylindrical, said body having a strut member separating said pair of spaced partial annular rings, and wherein said body having a partial annular member separating said pair of spaced partial annular rings.

10. The apparatus of claim 9, wherein said clamp receiving portion being positioned in the range of about 13–14 millimeters from the center of said body, and wherein said contact portion defining a substantially annular ring formed substantially parallel to said clamp receiving portion.

11. The apparatus of claim 10, wherein said body having a hardness within the range of about Rockwell C 44–48.

12. The apparatus of claim 3, wherein said clamping device receiver defining an opening in said body.

13. The apparatus of claim 12, wherein said clamping device receiver defining a pair of spaced partial annular rings, and the apparatus having associated therewith a hold down clamp with a pair of spaced forks for transmitting a clamping load to said clamping device receiver.

14. The apparatus of claim 13, wherein said body is substantially cylindrical, said body having a strut member separating said pair of spaced partial annular rings, and wherein said body having a partial annular member separating said pair of spaced partial annular rings.

15. The apparatus of claim 14, wherein said clamping device receiver being located in the range of about 13–14 millimeters from the center of said body, and wherein said contact portion defining an annular ring formed substantially parallel to said clamp receiving portion.

16. The apparatus of claim 15, wherein at least a portion of said body having a hardness within the range of about Rockwell C 44–48.

17. The apparatus of claim 16, wherein said body is unitary, and said body having a spring seat adjacent said aperture for receiving a spring associated with a fuel injector.

* * * * *